US008508542B2

(12) United States Patent
Sakariya et al.

(10) Patent No.: US 8,508,542 B2
(45) Date of Patent: Aug. 13, 2013

(54) SYSTEMS AND METHODS FOR OPERATING A DISPLAY

(75) Inventors: Kapil V. Sakariya, Sunnyvale, CA (US); Wei H. Yao, Fremont, CA (US)

(73) Assignee: Apple Inc., Cupertino, CA (US)

( * ) Notice: Subject to any disclaimer, the term of this patent is extended or adjusted under 35 U.S.C. 154(b) by 874 days.

(21) Appl. No.: 12/399,497

(22) Filed: Mar. 6, 2009

(65) Prior Publication Data

US 2010/0225657 A1 Sep. 9, 2010

(51) Int. Cl.
*G09G 5/36* (2006.01)
*G09G 5/39* (2006.01)

(52) U.S. Cl.
USPC ..... 345/545; 345/531

(58) Field of Classification Search
None
See application file for complete search history.

(56) References Cited

U.S. PATENT DOCUMENTS

| | | | | |
|---|---|---|---|---|
| 5,943,064 | A | 8/1999 | Hong | |
| 6,573,846 | B1 | 6/2003 | Trivedi | |
| 7,015,921 | B1 | 3/2006 | Trivedi | |
| 7,023,924 | B1 * | 4/2006 | Keller et al. | 375/240.26 |
| 7,230,633 | B2 | 6/2007 | Weybrew | |
| 7,272,670 | B2 | 9/2007 | Baker | |
| 7,305,540 | B1 | 12/2007 | Trivedi | |
| 7,312,800 | B1 | 12/2007 | Gies | |
| 7,414,600 | B2 | 8/2008 | Nathan | |
| 7,483,037 | B2 | 1/2009 | Gies | |
| 2003/0152080 | A1 * | 8/2003 | O'Brien | 370/392 |
| 2004/0129933 | A1 | 7/2004 | Nathan | |
| 2006/0054893 | A1 | 3/2006 | Nathan | |
| 2006/0227122 | A1 | 10/2006 | Proctor | |
| 2007/0097144 | A1 | 5/2007 | Gies | |
| 2007/0097146 | A1 | 5/2007 | Gies | |
| 2007/0182671 | A1 | 8/2007 | Nathan | |
| 2008/0012870 | A1 | 1/2008 | Gies | |
| 2008/0048951 | A1 | 2/2008 | Naugler, Jr. | |
| 2008/0062139 | A1 | 3/2008 | Hotelling | |
| 2008/0062140 | A1 | 3/2008 | Hotelling | |
| 2008/0109865 | A1 | 5/2008 | Su et al. | |
| 2008/0158167 | A1 | 7/2008 | Hotelling | |
| 2008/0164056 | A1 | 7/2008 | Gettemy | |
| 2008/0204431 | A1 | 8/2008 | Chung | |
| 2008/0235566 | A1 | 9/2008 | Carlson | |
| 2009/0002311 | A1 | 1/2009 | Barnhoefer | |
| 2009/0002401 | A1 | 1/2009 | Barnhoefer | |
| 2009/0002402 | A1 | 1/2009 | Barnhoefer | |
| 2009/0002403 | A1 | 1/2009 | Barnhoefer | |
| 2009/0002404 | A1 | 1/2009 | Barnhoefer | |
| 2009/0002555 | A1 | 1/2009 | Barnhoefer | |
| 2009/0002560 | A1 | 1/2009 | Barnhoefer | |
| 2009/0002561 | A1 | 1/2009 | Barnhoefer | |
| 2009/0002563 | A1 | 1/2009 | Barnhoefer | |

(Continued)

OTHER PUBLICATIONS

U.S. Appl. No. 12/399,526, filed Mar. 6, 2009, Kapil V. Sakariya.

(Continued)

*Primary Examiner* — Joni Richer
*Assistant Examiner* — Michelle Chin
(74) *Attorney, Agent, or Firm* — Fletcher Yoder PC

(57) ABSTRACT

Embodiments of the electronic device include a display driver with the ability to receive image data in a streaming display mode or a frame-buffered display mode. In some embodiments, the electronic device may switch seamlessly between the two display modes based on which display mode will provide reduced power usage given the type and/or variability of the image data being received.

23 Claims, 4 Drawing Sheets

(56) References Cited

U.S. PATENT DOCUMENTS

| | | | | |
|---|---|---|---|---|
| 2009/0002564 | A1 | 1/2009 | Barnhoefer | |
| 2009/0002565 | A1 | 1/2009 | Barnhoefer | |
| 2009/0009514 | A1 * | 1/2009 | Pagoulatos et al. | 345/424 |
| 2009/0079746 | A1 | 3/2009 | Howard | |

OTHER PUBLICATIONS

U.S. Appl. No. 61/046,737, filed Apr. 21, 2008, Al-Dahle et al.
U.S. Appl. No. 12/236,066, filed Sep. 23, 2008, Shawn Gettemy.
U.S. Appl. No. 12/286,394, filed Sep. 30, 2008, Yao.
U.S. Appl. No. 12/331,308, filed Dec. 10, 2008, Al-Dahle et al.

* cited by examiner

SYSTEMS AND METHODS FOR OPERATING A DISPLAY

BACKGROUND

The present disclosure relates generally to electronic displays. This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including consumer electronics such as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery powered devices or in other contexts where it is desirable to minimize power usage.

Typically, LCD panels include an array of pixels for displaying images. Image data related to each pixel may be sent by a processor to the LCD panel through a driver integrated circuit (IC). The driver IC then processes the image data and transmits corresponding voltage signals to the individual pixels. Typically, the method by which the driver IC receives and processes the image data is well suited for receiving certain types of image data, such as video images for example, but not as well suited for receiving other types of image data, such as still images.

SUMMARY

A summary of certain embodiments disclosed herein are set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure provide a system with a display that may operate in at least two display modes: a "frame-buffered" display mode, such as CPU-style interface, and a "streaming" display mode," such as an RGB-style interface. In the "frame-buffered" display mode, the processor writes image data to a frame memory of the driver IC as the image changes, and the driver IC periodically refreshes the display panel from the frame memory. In this method, the processor may reduce processing overhead by writing new image data to the driver IC frame memory only when some portion of the image changes. Furthermore, during periods when the image is still, the interface between the processor and the driver IC may be substantially unused, and the driver IC may continue to update the panel display from image data stored in the frame memory. Using this technique, the data transmission rate, i.e. the rate at which image data is transmitted from the processor to the driver IC, may be proportional to the degree to which the image changes, which may result in power savings if the image is updated infrequently. Therefore, this technique may work well for displaying images that are infrequently updated, such as menu images or word processing images, for example. However, because the processor updates the display by writing to driver IC memory, this technique may involve a higher level of processing overhead and power usage during periods of frequent image updates.

In the "streaming" display mode, the processor writes a continuous stream of image data to the driver IC, and the driver IC may process and route the streaming image data to the display panel without storing the data in a frame memory. In this method, the processor does not write to frame memory and, therefore, no memory addressing information may be included in the data stream. Using this technique, the processing overhead involved in writing data to the driver IC memory may be reduced. Therefore, this technique may work well for displaying images that change extensively over time, such as video images for example. In the streaming display mode, however, the processor continuously sends image data to the driver IC to refresh the display regardless of whether the displayed image is actually changing. Therefore, the processing overhead and power usage associated with transmitting data to the driver IC may remain the same even when the image data is updated infrequently.

In a typical electronic device with an LCD display, the method by which image data is sent to the driver IC is usually pre-determined according to the most common type of image data that is expected to be displayed and the resulting tradeoffs between power usage and memory cost. For example, an LCD television or media player may operate in a streaming display mode, i.e., using an RGB-style interface. This may reduce the cost of the display by eliminating the frame memory and may also reduce the processing overhead and power usage associated with addressing memory. A personal computer, on the other hand, may operate in a frame-buffered display mode, i.e., using a CPU-style interface, to take advantage of the reduced processing overhead and power usage provided during times that the display image is infrequently updated. In embodiments of the present disclosure, an electronic device includes circuitry for switching between the frame-buffered display mode and the streaming display mode, according to the type of image data being displayed at any given time. In this way, the relative advantages of both modes may be realized in one electronic device.

BRIEF DESCRIPTION OF THE DRAWINGS

Various aspects of this disclosure may be better understood upon reading the following detailed description and upon reference to the drawings in which.

DETAILED DESCRIPTION

The disclosure is generally directed to reducing processing overhead and, thus power usage, in an electronic device having a display. To reduce processing overhead, the electronic device may switch between at a frame-buffered display mode or a streaming display mode, depending on which display mode provides the greatest processing efficiency for the type of image data being displayed.

Figure 1:
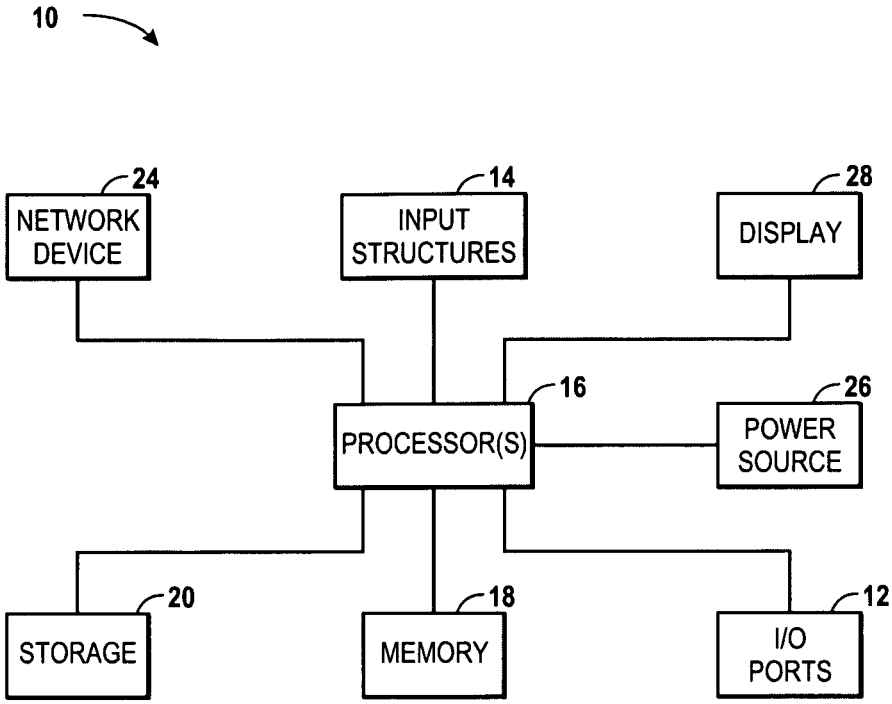
FIG. 1 is a block diagram of an example of components of an electronic device, in accordance with aspects of the present disclosure.

Turning now to the figures, FIG. 1 is a block diagram illustrating an example of electronic device 10 that may employ the display mode switching techniques disclosed herein. Electronic device 10 may be any device that includes a display, such as a mobile phone, a personal computer, a laptop, a portable media player, a television, etc. Electronic device 10 may include various internal and/or external components that contribute to the function of electronic device 10. Those of ordinary skill in the art will appreciate that the various functional blocks shown in FIG. 1 may include hardware elements (including circuitry), software elements (including computer code stored on a computer-readable medium) or a combination of both hardware and software elements. It should further be noted that FIG. 1 merely illustrates one example of a particular implementation and is merely intended to illustrate the types of components that may be present in electronic device 10. For example, in the presently illustrated embodiment, these components may include input/output (I/O) ports 12, input structures 14, one or more processors 16, memory device 18, non-volatile storage 20, networking device 24, power source 26, and display 28. By way of example, electronic device 10 may be a model of an iPod® or iPhone® available from Apple Inc. of Cupertino, Calif. or any other portable electronic device. For another example, electronic device 10 may be a desktop or laptop computer, including a MacBook®, MacBook® Pro, MacBook Air®, iMac®, Mac® mini, or Mac Pro® available from Apple Inc.

Display 28 may be used to display various images generated by electronic device 10. Display 28 may be any suitable display such as a liquid crystal display (LCD), plasma display, or an organic light emitting diode display, for example. In one embodiment, display 28 may be an LCD employing in-plane switching (IPS), twisted nematic, electrically compensated birefringence, or other techniques useful in operating such LCD devices. Additionally, in certain embodiments of electronic device 10, display 28 may be provided in conjunction with a touch-sensitive element, such as a touch screen, that may be used as part of the control interface for electronic device 10. As in processor 16, display 28 may also include circuitry configured to switch processor 16 and display 28 between the frame-buffered display mode and the streaming display mode.

Figure 2:
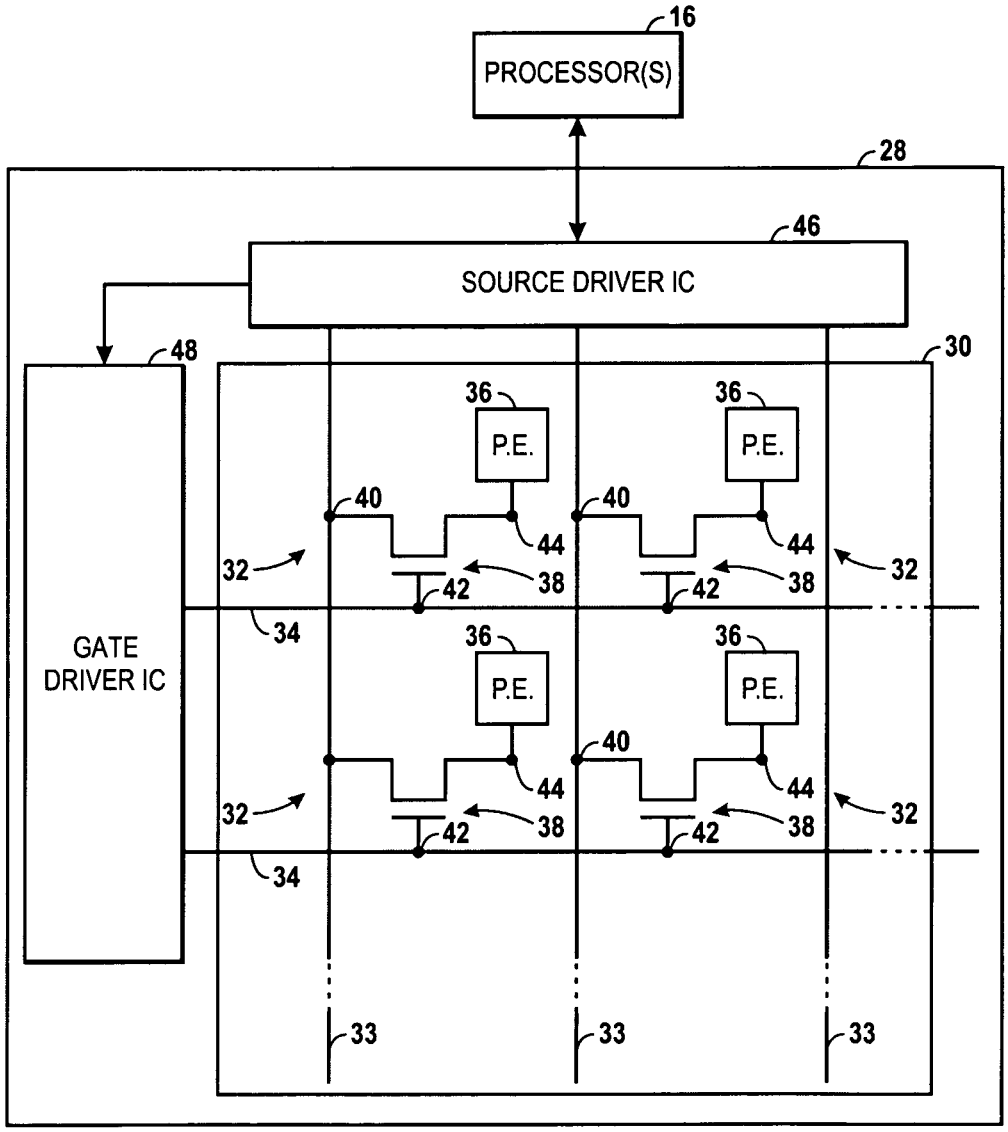
FIG. 2 is a circuit diagram of switching and display circuitry of the display of FIG. 1, in accordance with aspects of the present disclosure.

Referring now to FIG. 2, a circuit diagram of display 28 is provided. As shown in FIG. 2, display 28 may include display panel 30, which includes a matrix of pixels 32 and forms an image display region of display 28. In such a matrix, each pixel 32 may be defined by the intersection of data lines 33 and scanning or gate lines 34. Each pixel 32 may include a pixel electrode (P.E.) 36 and thin film transistor (TFT) 38 for switching pixel electrode 36. The source 40 of each TFT 38 may be electrically connected to one of data lines 33, and the gate 42 of each TFT 38 may be electrically connected to one of gate lines 34. Furthermore, the drain 44 of the respective TFT 38 may be electrically connected to pixel electrode 36.

Each TFT 38 serves as a switching element which may be activated and deactivated (i.e., turned on and off) for a predetermined period based on the respective presence or absence of a scanning signal at gate 42 of TFT 38. When activated, TFT 38 may store the image signals received via the respective data line 33 as a charge in pixel electrode 36. The image signals stored at pixel electrode 36 may be used to generate an electrical field that energizes the respective pixel electrode 36 and causes pixel 32 to emit light at an intensity corresponding to the applied voltage. For example, in an LCD display, such an electrical field may align liquid crystals within a liquid crystal layer (not shown) to modulate light transmission through the liquid crystal layer.

Display 28 may also include source driver IC 46, which may include a chip, such as a processor or an application-specific integrated circuit (ASIC), that is configured to control various aspects of display 28. For example, source driver IC 46 may receive image data from processor 16 and send corresponding image signals to pixels 32. Source driver IC 46 may also be coupled to gate driver IC 48, which activates or deactivates pixels 32 through gate lines 34. As such, source driver IC 46 may send timing information to gate driver IC 48, regarding the activation of individual rows of pixels 32. The illustrated embodiment includes a single source driver IC 46 and a single gate driver IC 48 coupled to LCD panel 30, but other embodiments may include two or more source driver ICs 46 and two or more gate driver ICs 48. For example, some embodiments may include several source driver ICs 46 and several gate driver ICs 48 disposed along the sides of LCD panel 30, such that each source driver IC 46 may control a subset of source lines 33 and each gate driver IC 48 may control a subset of gate lines 34. Furthermore, the source driver ICs 46 and the gate driver ICs 48 may be implemented in the same semiconductor chip.

In operation, source driver IC 46 receives image data from processor 16 and, based on this data, outputs signals that adjust pixels 32. To display the image, source driver IC 46 may adjust the voltage of pixel electrodes 36 one row at a time. To access an individual row of pixels 32, gate driver IC 48 may send an activation signal to the specific TFTs 38 associated with the row of pixels 32 being addressed. This activation signal may render TFTs 38 on the addressed row conductive. Image data appropriate for the addressed row may then be transmitted from source driver IC 46 to each pixel 32 through data lines 33. After the row of pixels 32 are adjusted, gate driver IC 48 may then deactivate TFTs 38 in the addressed row, thereby impeding pixels 32 from changing until the next time that they are addressed. The above process may be repeated for each row of pixels 32 to produce an image.

Figure 3:
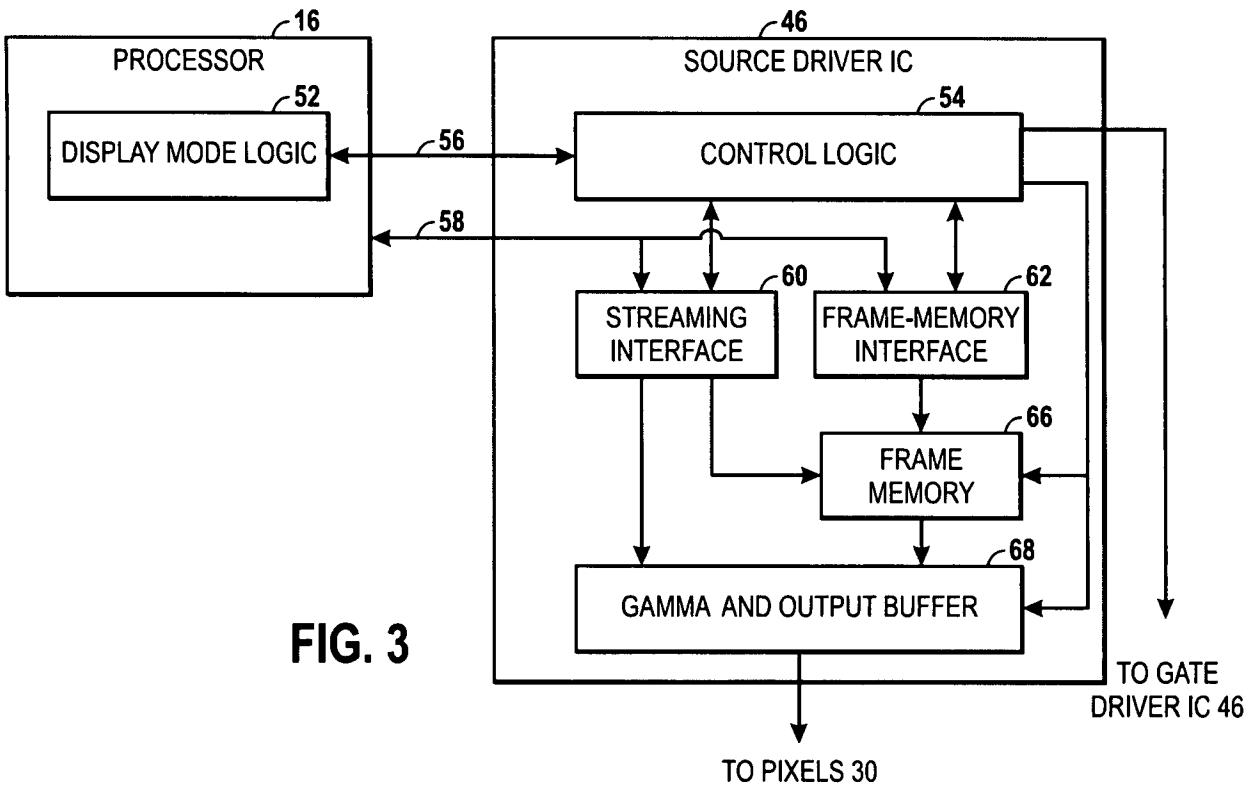
FIG. 3 is a more detailed block diagram of the processor and the source driver IC shown in FIG. 2, in accordance with aspects of the present disclosure.

As will be explained further below with reference to FIG. 3, source driver IC 46 may include circuitry that enables display 28 to process image data received from processor 16 in either a streaming display mode or a frame-buffered display mode. Furthermore, processor 16 and source driver IC 46 may be configured to switch between the frame-buffered, e.g. CPU-style, display mode and streaming, e.g. RGB-style, display mode, depending on the type of image data being displayed. As shown in FIG. 3, both processor 16 and source driver IC 46 include logic blocks that control the display mode of electronic device 10. Specifically, processor 16 may include display mode logic 52 and source driver IC 54 may include control logic 54. Display mode logic 52 of processor 16 may be communicatively coupled to control logic 54 of source driver IC 46 through communication interface 56. Display mode logic 52 of processor 16 determines whether device 10 will operate in the frame-buffered display mode or the streaming display mode. The chosen display mode may then be communicated to the control logic 54 through communication interface 56. Furthermore, control logic 54 may send a return signal to processor 16 indicting the mode in which source driver IC 46 is currently operating and/or whether source driver IC 46 is ready to operate in the new display mode.

In some embodiments, the processor 16 may chose between the frame-buffered display mode and the streaming display mode based on the expected power usage of the device 10 for each display mode. As such, the processor 16 may monitor the display image to determine the image variability, i.e. the degree to which the display image is changing or is expected to change for a specified period of time. The processor 16 may then determine the display mode based on which display mode will be expected to use less power for the determined image variability. For example, if the image variability is high, then the average power usage may be lower for the streaming display mode due to the reduced processing overhead provided by eliminating the writing of the frame memory 66. However, if the image variability is low, then the average power usage of the device 10 may be lower for the frame-buffered display mode due to the lower average data transmission rate from the processor 16 to the driver IC 46. In some embodiments, the correlation between the image variability and the power usage may be determined empirically for individual types of devices, and programmed into the display mode logic 52.

The image data may be sent from processor 16 to source driver IC 46 over a data bus 58. In some embodiments, data bus 58 may include a first bus for transmitting image data in the streaming display mode and a second bus for transmitting image data in the frame-buffered display mode. In other embodiments, however, data bus 58 may be a single bus that may be adapted to operate in either display mode. Data bus 58 may be coupled to streaming interface 60 and frame-memory interface 62, both of which receive image data from processor 16, process the image data, and transmit corresponding image signals to pixels 32 as discussed above in reference to FIG. 2. Streaming interface 60 and frame-memory interface 62 may be switched on or off by control logic 54 of source driver IC 46 depending on the display mode chosen by processor 16.

Frame-memory interface 62 may be coupled to frame memory 66, which may serve to store image data received for the frame-buffered, i.e., CPU-style, display mode. The output of frame memory 66 and streaming interface 60 may be coupled to a gamma and output buffer block 68. The gamma and output buffer block 68 receives digital image data from frame memory 66 and streaming interface 60 and converts the digital image data into suitable analog voltage signals for energizing pixel electrodes 36.

Streaming interface 60 may be used to process image data received from processor 16 when operating in the streaming display mode. The image data received by the streaming interface may be referred to as "streaming" image data. The streaming image data may include a series of data samples corresponding to individual pixels of the image and may also include timing information that correlates the data samples to the proper location in the matrix of pixels 32. The timing information may include line sync signals that separate the pixel data according to lines on display panel 30 and frame sync signals that separate the pixel data according to individual frames. In this way, the timing information provides a proper correlation between the pixel data contained in the stream and the actual pixels 32 to which the pixel data should be sent.

When operating in the streaming, i.e. RGB-style, display mode, processor 16 maintains the image on display 28 by continuously sending current image data to source driver IC 46 for each pixel 32 of each image frame. The timing information may be processed by streaming interface 60 to determine the proper spatial allocation of image data to display panel 30. For example, based on the timing information, streaming interface 60 may send a timing signal to control logic 54, and control logic 54 may then send appropriate timing signals to gate driver IC 48. In response to the timing signals, gate driver IC 48 may then scan pixels 32, i.e. sequentially activate individual rows of pixels 32, while streaming interface 60 sequentially updates each pixel 32 in the activated row. In some embodiments, streaming interface 60 may also include a line buffer (not shown) or pixel buffer (not shown) to temporarily hold the pixel data that is about to be sent to display panel 30. As will be explained further below, streaming interface 60 may also be coupled to frame memory 66 to enable streaming interface 60 to copy image data to frame memory 66 while switching from the streaming display mode to the frame-buffered display mode. In this way, electronic device 10 may provide a seamless transition in the event of a switch from the streaming display mode to the frame-buffered display mode.

Frame-memory interface 62 may be used to process image data received from processor 16 when operating in the frame-buffered, i.e. CPU-style, display mode. When operating in the frame-buffered display mode, frame-memory interface 62 may receive image data from processor 16 as write operations to a memory, such as frame memory 66. Accordingly, the image data received by frame-memory interface 62, which may be referred to as "memory-addressed" image data, may include a memory address byte, corresponding to a selected memory location of frame memory 66, and a data byte corresponding to the pixel data to be stored in the selected memory location. Frame-memory interface 62 may then process the write operation and write the data to frame memory 66. Meanwhile, independently of the updating of frame memory 66, frame memory 66 may be periodically re-transmitted to display panel 30. In the frame-buffered display mode, the timing of the frame update is not based on timing information contained in the image data. Rather, source driver IC 46 may have an internal clock that determines how often display panel 30 is refreshed from frame memory 66. Each time display panel 30 is refreshed, the contents of frame memory 66 may be transferred to the corresponding pixels 32. Regarding the former, the amount of data sent to source driver IC 46 may be proportional to the degree to which the image is changing. In fact, if the image is not changing at all, frame-memory interface 62 may not receive any new image data from the processor 16. Therefore, in some embodiments control logic 54 of source driver IC 46 may cause frame-memory interface 62 to enter a sleep mode if the image remains still for a specified period of time.

With the forgoing in mind, the operation of each display method may be better understood. In the streaming display mode, the transmission of individual pixel data to source drive IC 46 may occur more efficiently compared to the frame-buffered display mode, because the streaming display mode does not rely on writing the pixel data to individual memory addresses of frame memory 66. Therefore, the streaming display mode may be better suited for displaying frequently updated images such as video, wherein the transmission efficiency may reduce the overall image processing overhead compared to the frame-buffered display mode. The streaming display mode, however, may not be well suited for infrequently updated images, because to maintain the displayed image, processor 16 continuously transmits image data to source driver IC 46 at the panel refresh rate regardless of whether the image is actually changing, which may resulting in multiple redundant transmissions of the same image data.

By comparison, in the frame-buffered display mode, processor 16 may transfer image data to source driver IC 46 one pixel at a time as the image data for each pixel 32 changes.

Therefore, even though the transmission of individual data pixels 32 may be less efficient in the frame-buffered display mode, redundant image data may not re-transmitted for parts of the image that have not changed. Therefore, the frame-buffered display mode may be better suited for displaying infrequently updated images, such as still pictures, menus, or text, wherein the overall processing overhead may be reduced by the fact that the data transmission rate from processor 16 to source driver IC 46 is lower.

Figure 4:
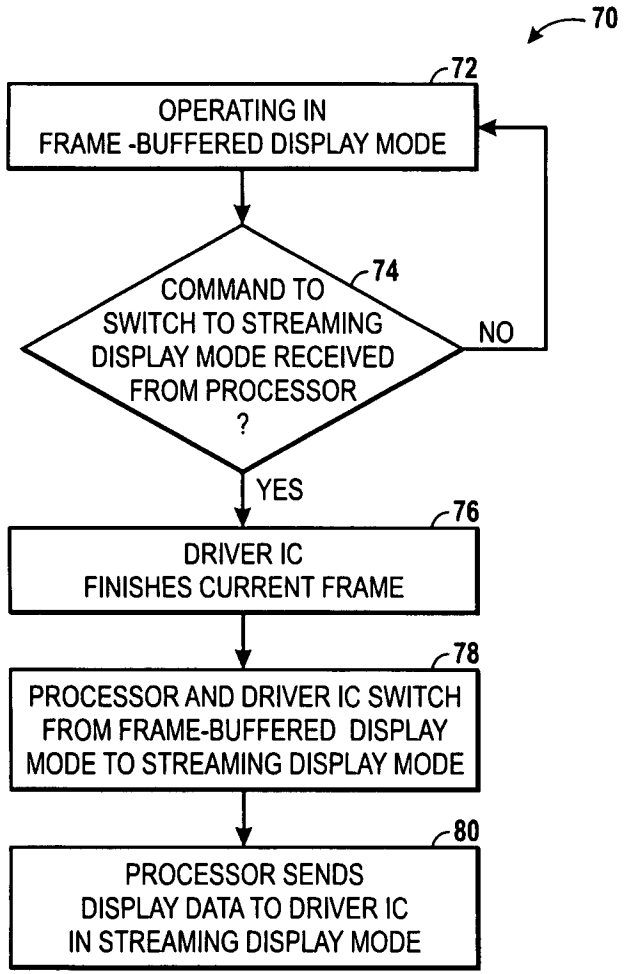
FIG. 4 is a flow diagram illustrating a method of switching from a frame-buffered display mode to a streaming display mode, in accordance with aspects of the present disclosure.
Figure 5:
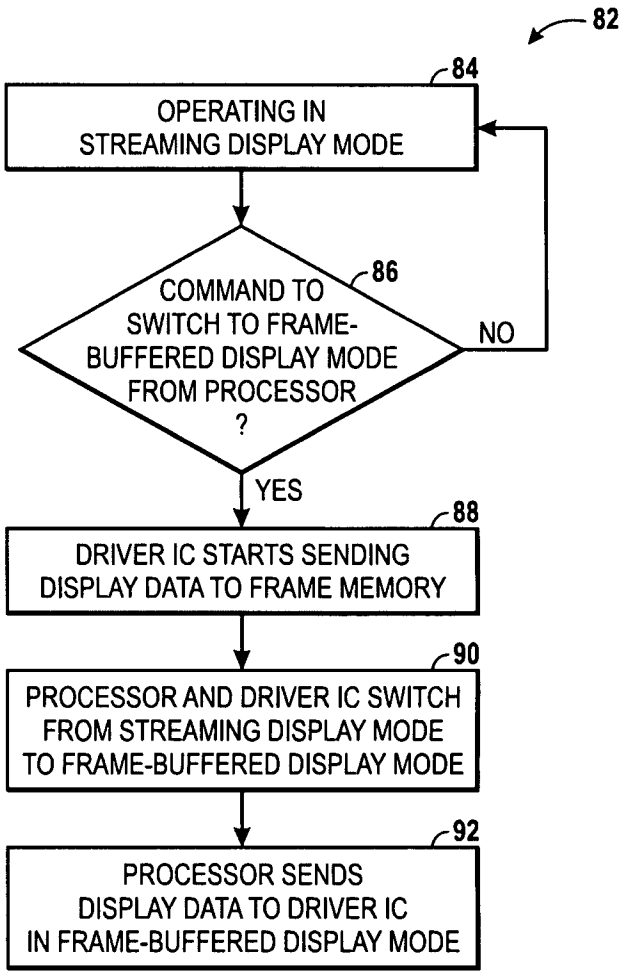
FIG. 5 is a flow diagram illustrating a method of switching from a streaming display mode to a frame-buffered display, in accordance with aspects of the present disclosure.

Turning now to FIGS. 4 and 5, methods of switching between the streaming display mode and the frame-buffered display mode will be described. FIG. 4 illustrates a method wherein display 28 and processor 16 switch from the frame-buffered (CPU) display mode to the streaming (RGB) display mode, while FIG. 5 illustrates a method wherein display 28 and processor 16 switch from the streaming (RGB) display mode to the frame-buffered (CPU) display mode. In both methods, steps are implemented to provide a seamless transition from one display mode to another so that the switch is unnoticed by the user of electronic device 10.

Turning first to FIG. 4, one embodiment of a method of switching from the frame-buffered display mode to the streaming display mode is shown. Method 70 starts with the device operating in the frame-buffered display mode. In the frame-buffered display mode, control logic 54 switches on frame-memory interface 62 and frame memory 66 and switches off streaming interface 60 so that the memory-addressed image data sent by processor 16 is received and processed by frame-memory interface 62. The writing of frame memory 66 may be performed via random access by sending an address byte and a data byte for each pixel of image data. In some embodiments, the writing of frame memory 66 may be performed through a block write using direct memory address (DMA) by sending a start address, block length, and series of data bytes. Furthermore, the processor 16 may reduce processing overhead by writing new image data to the frame memory 66 only when some portion of the display image changes. Accordingly, the average data transmission rate of image data being sent to source drive IC 46 may be proportional to the frequency with which the image changes. Meanwhile, source driver IC 46 continues to send the image data held by frame memory 66 to display panel 30.

At step 74, source driver IC 46 determines whether processor 16 has commanded source driver 46 to switch to the streaming display mode. If processor 16 has not commanded a switch to the streaming display mode, then source driver IC 46 continues to step 72 and remains in the frame-buffered display mode. If however, processor 16 has commanded a switch to the streaming display mode, then source driver IC 46 continues to step 76, wherein the process of switching to the streaming display mode begins. As discussed above, the switch to the streaming display mode may, in some embodiments, be triggered based on the variability of the displayed image as tracked by the processor 16. For example, processor 16 may command a switch to the streaming display mode if the image variability exceeds a rate of approximately 20 to 50 percent pixel change per frame. In yet other embodiments, the switch to the streaming display mode may be triggered if the image being displayed by processor 16 is a type of image expected to be updated frequently. For example, if the user of electronic device 10 runs a software application associated with displaying video, such as a media player, processor 16 may command a switch to the streaming display mode.

At step 76, source driver IC 46 starts to switch to the streaming display mode. As indicated at step 76, source driver IC 46 first completes sending the current frame of image data to display panel 30. Source driver IC 46 then enters a wait mode, wherein the display panel 30 is no longer refreshed from frame memory 66. In some embodiments, control logic 54 may power down frame memory 66 to conserve power while frame memory 66 is not in use. At step 78, processor 16 and source driver IC 46 switch to the streaming display mode. To accomplish the switch, control logic 54 of source driver IC 46 may switch frame-memory interface 62 off and switch streaming interface 60 on. At substantially the same time, control logic 54 may send a confirmation signal to display mode logic 52 of processor 16 indicating that source driver IC 46 has finished refreshing display panel 30 and is now ready to receive streaming image data in the streaming display mode.

At step 80, upon receiving the confirmation signal from source driver IC 46, processor 16 begins sending streaming image data to source driver IC 46. Streaming interface 60 of source driver IC 46 receives and processes the streaming image data as discussed above in reference to FIG. 3. Processor 16 and source driver IC 46 continue to operate in the streaming display mode until processor 16 commands a switch to the frame-buffered display mode, as described below in reference to FIG. 5.

Turning now to FIG. 5, a method of switching from the streaming display mode to the frame-buffered display mode is shown, in accordance with certain embodiments. Method 82 starts at step 84 with electronic device 10 operating in the streaming display mode. In the streaming display mode, control logic 54 switches on streaming interface 62 and switches off frame-memory interface 62 and frame memory 66 so that streaming image data sent by processor 16 is received and processed by streaming interface 62. Streaming interface 62 then processes the received image data and sends the image data to panel 30 continuously as the image data is processed.

At step 86, source driver IC 46 determines whether processor 16 has commanded it to switch to the frame-buffered display mode. If processor 16 has not commanded a switch to the frame-buffered display mode, then source driver IC 46 continues to step 84 and remains in the streaming display mode. If, however, processor 16 has commanded a switch to the frame-buffered display mode, then source driver IC 46 continues to step 88, wherein the process of switching to the frame-buffered display mode begins. As discussed above, the switch to the frame-buffered display mode may, in some embodiments, be triggered based on the variability of the displayed image as tracked by the processor 16. For example, processor 16 may command a switch to the frame-buffered display mode if the image variability falls below a rate of approximately 20 to 50 percent pixel change per frame. In some embodiments, the switch to the frame-buffered display mode may be triggered if the image being displayed by processor 16 is a type of image expected to be updated infrequently. For example, if the user of electronic device 10 runs a word processing application or an application associated with displaying still pictures, processor 16 may switch to the frame-buffered display mode.

At step 88, source driver IC 46 starts to switch to the frame-buffered display mode by copying the streaming image data received from processor 16 to frame memory 66. Accordingly, in embodiments wherein frame memory 66 is powered down when not in use, control logic 54 may power up frame memory 66 to enable it to receive image data from streaming interface 60. While copying the image data to frame memory 66, source driver IC 46 also continues sending corresponding image signals to display panel 30. After frame memory 66 is filled with image data corresponding to a complete image (i.e. not two half frames), method 82 advances to step 90, wherein both processor 16 and source driver IC 46 switch to the frame-buffered display mode. To accomplish the switch, control logic 54 of source driver IC 46 may switch streaming interface 60 off and switch frame-memory interface 62 on. At substantially the same time, control logic 54 may send a confirmation signal to display mode logic 52 of processor 16 indicating that source driver IC 46 has finished filling frame memory 66 and is now ready to receive memory-addressed image data in the frame-buffered display mode. Additionally, control logic 54 may also initiate frame memory 66 to begin sending data to display panel 30.

At step 92, upon receiving the confirmation signal from source driver IC 46, processor 16 begins sending memory-addressed image data to source driver IC 46 in the frame-buffered display mode. Frame-memory interface 60 of source driver IC 46 then receives the image data and processes the image data as discussed above. Processor 16 and source driver IC 46 then continue to operate in the frame-buffered display mode until processor 16 commands a switch to the streaming display mode, as described above in reference to FIG. 4.

Using the methods described above, it will be appreciated that switching between the streaming display mode and the frame-buffered display mode may occur without a noticeable interruption of the image displayed on display panel 30. In some embodiments, electronic device 10 may also be configured to prevent processor 16 from switching between modes too frequently, such as by using a hysteresis loop. For example, in embodiments wherein the switch between modes is based on image variability, electronic device 10 may be configured to switch to the frame-buffered display mode when the image variability falls below approximately 20 percent, and switch to the streaming display mode when the image variability rises above approximately 30 percent. For another example, in embodiments wherein the switch between modes is based on the type of image data being displayed, the processor 16 may be configured to switch to a new mode after the new image data is displayed for a specified length of time.

What is claimed is:

1. An electronic device, comprising:

a processor operative to generate image data; and a display communicatively coupled to the processor and operative to:

receive the image data from the processor and display an image based on the image data received from the processor, wherein the processor and the display are configured to operate in a streaming mode and a frame-buffered mode, and wherein in the frame-buffered mode, the processor stores the image data to a frame memory of the display, and in the streaming mode, the processor does not store the image data to the frame memory of the display; and switch alternatively between the streaming mode and the frame-buffered mode based at least in part on a characteristic of the image data.

2. The electronic device of claim 1, wherein the processor and the display are configured to switch between the streaming mode and the frame-buffered mode based on the type of image being displayed.

3. The electronic device of claim 1, wherein the processor and the display are configured to switch between the frame-buffered mode and the streaming mode based on a rate of transmission of the image data to the display.

4. The electronic device of claim 1, wherein the processor and the display are configured to switch from the frame-buffered mode to the streaming mode if a variability of the image data exceeds a specified percentage of pixels per frame.

5. The electronic device of claim 1, comprising a single data bus configured to send memory-addressed image data or streaming image data from the processor to the display alternatively.

6. The electronic device of claim 1, comprising a first data bus configured to send streaming image data from the processor to the display during the streaming mode, and a second data bus configured to send memory-addressed image data from the processor to the display during the frame-buffered mode.

7. The electronic device of claim 6, wherein the processor is configured to activate the first bus or the second bus alternatively.

8. A display comprising:

a display panel comprising a matrix of pixels configured receive image signals; and a driver configured to receive image data deriving from a processor and send corresponding image signals to the display panel, wherein the driver is configured to receive the image data directly from the processor when operating in a streaming mode and from the processor via a frame memory when operating in a frame-buffered mode, wherein the driver is configured to switch between the streaming mode and the frame-buffered mode based at least in part on a characteristic of the image data.

9. The display of claim 8, wherein the driver comprises a first interface configured to receive streaming image data from the processor, a second interface configured to receive memory-addressed image data from the processor, and a memory configured to receive the memory-addressed image data from the second interface.

10. The display of claim 8, wherein the first interface is configured to send image signals to the display panel and simultaneously copy the streaming image data to the memory.

11. The display of claim 8, wherein the driver comprises control logic configured to receive a command from the processor to switch between the streaming mode and the frame-buffered mode.

12. The display of claim 11, wherein the control logic is configured to send a confirmation signal to the processor indicating that the driver is ready to receive the streaming image data or memory-addressed image data.

13. The display of claim 12, wherein the control logic is configured to power down the frame memory while operating in the streaming mode.

14. A method of operating an electronic device, comprising:

in a frame-buffered display mode:

receiving memory-addressed image data from a processor;

storing the memory-addressed image data to a frame memory;

sending image signals corresponding to the memory-addressed image data stored in the frame memory to a display panel; and receiving a command from the processor to switch to a streaming display mode, wherein, in the streaming display mode, the memory-addressed image data is not to be stored to the frame memory.

15. The method of claim 14, comprising:

sending a last frame of the image signals to the display panel in response to the command;

sending a confirmation signal to the processor indicating a readiness to switch to the streaming display mode; and receiving streaming image data from the processor.

16. The method of claim 15, comprising powering down the frame memory after sending the last frame of the image signals to the display panel.

17. A method, comprising:

in a streaming display mode:

receiving streaming image data from a processor;

sending image signals corresponding to the streaming image data to a display panel; and receiving a command from the processor to switch to a frame-buffered display mode, wherein, in the frame-buffered display mode, the streaming image data is to be stored to a frame memory.

18. The method of claim 17, comprising:

copying the streaming image data to a frame memory in response to the command while continuing to send the image signals corresponding to the streaming image data to the display panel;

sending a confirmation signal to the processor after substantially filling the frame memory, the confirmation signal indicating a readiness to switch to the frame-buffered display mode;

receiving the memory-addressed image data from the processor; and storing the memory-addressed image data to a frame memory.

19. The method of claim 18, comprising sending image signals corresponding to the memory-addressed image data stored in the frame memory to a display panel.

20. A method, comprising:

receiving image data from a processor in a first display mode;

sending the image data received in the first display mode to a display panel;

receiving a command from the processor to switch to a second display mode;

receiving the image data from the processor in the second display mode; and sending the image data received in the second display mode to the display panel;

wherein one of the first display mode and the second display mode comprises a frame-buffered display mode and the other one of the first display mode and the second display mode comprises a streaming display mode, and wherein, in the frame-buffered display mode, the image data is stored to a frame memory, and in the streaming display mode, the image data is not stored to the frame memory before being sent to the display panel.

21. The method of claim 20, comprising sending a confirmation signal to the processor to indicate a readiness to begin receiving the image data from the processor in the second display mode.

22. The method of claim 20, wherein the command from the processor to switch to the second display mode is based on a degree of variability of the image data.

23. The method of claim 20, wherein the command from the processor to switch to the second display mode is triggered based on a first average power usage corresponding with the first display mode being higher than a second average power usage corresponding with the second display mode.

* * * * *